US012303031B2

(12) United States Patent
Tsai et al.

(10) Patent No.: US 12,303,031 B2
(45) Date of Patent: May 20, 2025

(54) BAFFLE STRUCTURE, WITH A VARIABLE POSITION INSTALLED ON THE CABINET, AND A CABINET CONTAINING A BAFFLE STRUCTURE

(71) Applicant: Fulian Precision Electronics (Tianjin) Co., LTD., Tianjin (CN)

(72) Inventors: Ti-An Tsai, New Taipei (TW); Tien-Hung Lin, New Taipei (TW)

(73) Assignee: Fulian Precision Electronics (Tianjin) Co., LTD., Tianjin (CN)

( * ) Notice: Subject to any disclaimer, the term of this patent is extended or adjusted under 35 U.S.C. 154(b) by 203 days.

(21) Appl. No.: 18/126,328

(22) Filed: Mar. 24, 2023

(65) Prior Publication Data

US 2023/0301430 A1 Sep. 28, 2023

(30) Foreign Application Priority Data

Mar. 28, 2022 (CN) ..... 202210312694.7

(51) Int. Cl.
*A47B 96/20* (2006.01)

(52) U.S. Cl.
CPC ..... *A47B 96/20* (2013.01); *A47B 2220/0002* (2013.01)

(58) Field of Classification Search
CPC ..... A47B 96/20; A47B 2220/0002
USPC ..... 312/351.1, 205
See application file for complete search history.

(56) References Cited

U.S. PATENT DOCUMENTS 2,988,380 A * 6/1961 Puckett ..... B60P 3/32 160/222
3,218,091 A * 11/1965 Doak ..... B60P 3/32 160/222
3,722,156 A * 3/1973 Bryant ..... B60P 3/36 52/155
4,974,500 A * 12/1990 Boyd ..... A47B 31/02 221/96
5,165,770 A * 11/1992 Hahn ..... H02B 1/565 312/265.6
5,372,262 A * 12/1994 Benson ..... A47B 47/02 312/265.4
5,558,417 A * 9/1996 Termotto ..... A47B 49/00 312/249.7
6,223,908 B1 * 5/2001 Kurtsman ..... H04Q 1/08 211/175

(Continued)

FOREIGN PATENT DOCUMENTS

CN 102480080 A 5/2012
CN 214507032 U 10/2021

*Primary Examiner* — James O Hansen
(74) *Attorney, Agent, or Firm* — ScienBiziP, P.C.

(57) ABSTRACT

A baffle structure, with a variable position installed on the cabinet. The baffle structure comprises a board, adjusting element, and fixing element. A first slot is defined on the board, and the first slot extends along the first direction. The adjusting element is slidably arranged in the first slot, and partially extends outside the first slot until it fits with a main body of the cabinet. The board is positioned relative to the main body on the second direction. The fixing element is set on the board and configured to position the board relative to the main body on the third direction. The second direction is perpendicular to first direction, and the third direction is perpendicular to the first direction and the second direction.

18 Claims, 9 Drawing Sheets

(56) References Cited

U.S. PATENT DOCUMENTS

| | | | | |
|---|---|---|---|---|
| 6,283,563 | B1 * | 9/2001 | Lambright | A47B 45/00<br>312/203 |
| 7,954,912 | B1 * | 6/2011 | Bergesch | E05C 9/02<br>292/38 |
| 2007/0215765 | A1 * | 9/2007 | Nagel | A47B 47/04<br>108/106 |

* cited by examiner

BAFFLE STRUCTURE, WITH A VARIABLE POSITION INSTALLED ON THE CABINET, AND A CABINET CONTAINING A BAFFLE STRUCTURE

FIELD

The subject matter herein generally relates to cabinet, specifically to a baffle structure.

BACKGROUND

The baffle structure is usually fixed to the bottom of the cabinet, but when the height of the cabinet from the ground changes, the height of the baffle structure cannot be adapted, and it is necessary to provide a baffle structure with an adjustable installation position for installation and disassembly.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
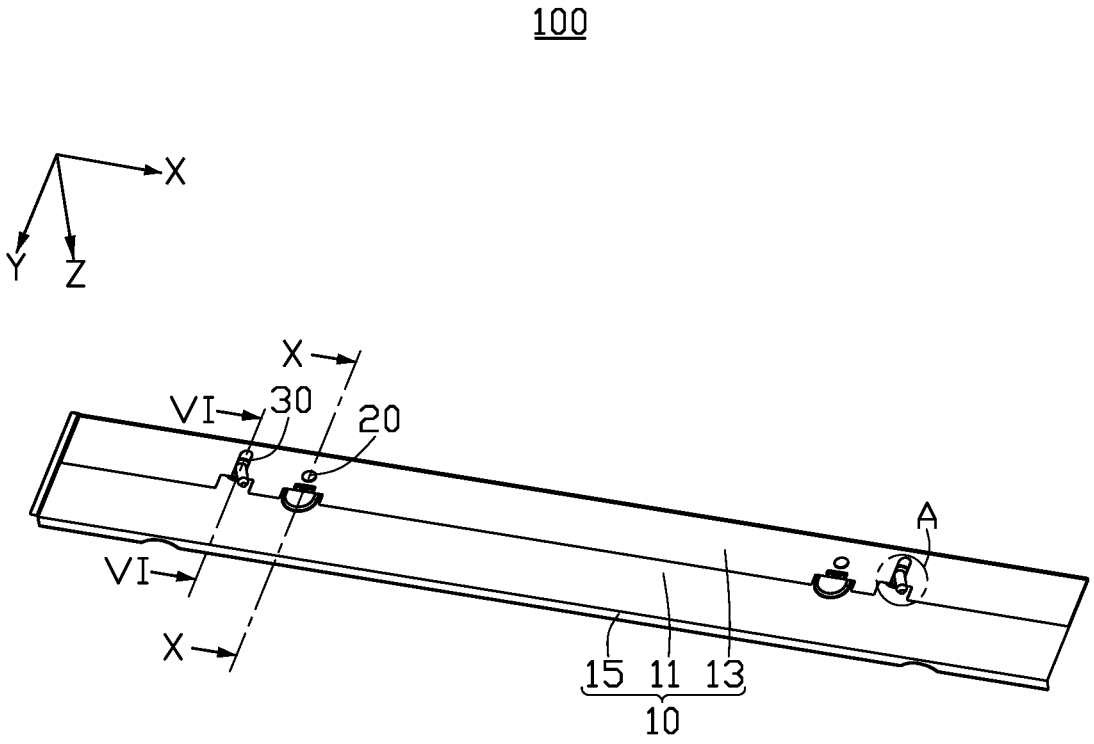
FIG. 1 is an isometric, assembled view of a baffle structure provided by an embodiment of the present application.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiment described herein. However, it will be understood by those of ordinary skill in the art that the embodiment described herein could be practiced without these specific details. In other instances, methods, procedures, and components have not been described in detail so as not to obscure the related relevant feature being described. Also, the description is not to be considered as limiting the scope of the embodiment described herein. The drawings are not necessarily to scale and the proportions of certain parts have been exaggerated to better illustrate details and features of the present disclosure.

The present disclosure, including the accompanying drawings, is illustrated by way of examples and not by way of limitation. Several definitions that apply throughout this disclosure will now be presented. It should be noted that references to "an" or "one" embodiment in this disclosure are not necessarily to the same embodiment, and such references mean "at least one."

The term "coupled" is defined as connected, whether directly or indirectly through intervening components, and is not necessarily limited to physical connections. The connection can be such that the objects are permanently connected or releasably connected. The term "comprising" means "including, but not necessarily limited to"; it specifically indicates open-ended inclusion or membership in a so-described combination, group, series, and the like.

Without a given definition otherwise, all terms used have the same meaning as commonly understood by those skilled in the art. The terms used herein in the description of the present disclosure are for the purpose of describing specific embodiment only, and are not intended to limit the present disclosure.

Figure 2:
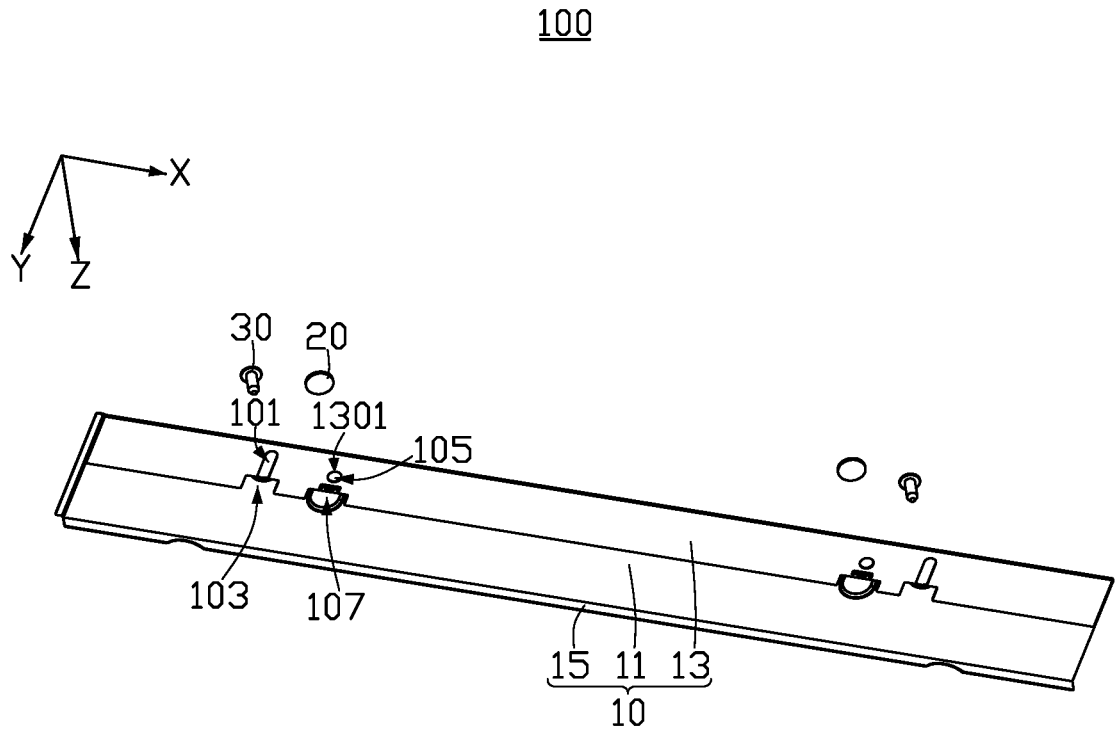
FIG. 2 is an isometric, exploded view of the baffle structure shown in FIG. 1.

As show in FIG. 1 and FIG. 2, an embodiment provides a baffle structure 100 for installation on a main body 201 of a cabinet 200. The main body 201 is placed on a mounting surface. The baffle structure 100 comprises a board 10, a fixing element 20, and an adjusting element 30. The first slot 101 is defined on the board 10. The adjusting element 30 is installed in the first slot 101 and could slide along the first slot 101.

The extension direction of the first slot 101 is a first direction Y, and the adjusting element 30 slides along the first direction Y relative to the first slot 101. The direction of the two opposite side wall 1011 of the first slot 101 stop adjusting element 30 is a second direction X. The two side walls 1011 of the first slot 101 are spaced apart and extend along the first direction Y, and the two side walls 1011 prevent the adjustment element 30 from moving in a direction perpendicular to the first direction Y. The second direction X is perpendicular to the first direction Y. The direction in which the baffle structure 100 faces the main body 201 is a third direction Z. The third direction Z is perpendicular to the second direction X and perpendicular to the first direction Y.

In an embodiment, the mounting surface is the ground, the main body 201 is a base structure, the main body 201 is placed on the mounting surface, the first direction Y is the vertical direction, and the second direction X and third direction Z are parallel to the horizontal direction. The baffle structure 100 has a wind shielding effect on the space between the base structure and the ground, and prevents impurities such as dust and liquid from entering the space.

The adjusting element 30 cooperates with the main body 201 to limit the displacement of the board 10 relative to the main body 201 along the second direction X. The fixing element 20 is fixed on the board 10 and adsorbed on the main body 201. The fixing element 20 limits the displacement of the board 10 relative to the main body 201 along the third direction Z. The adjusting element 30 slides within the first slot 101 to adjust the relative position of the board 10 and the main body 201 in the first direction Y. Adjusting the position of the scaffold structure 100 installed on the main body 201 along the first direction Y, which is suitable for the size change of the main body 201 at the first direction Y.

In an embodiment, the board 10 is supported on the mounting surface to improve the positional stability of board 10 and main body 201 along first direction Y.

If the bottom of the board 10 is not supported, that is, when the board 10 and the mounting surface are not in contact, the board 10 could fall relative to the main body 201 along the first direction Y under the action of gravity until the bottom of the board 10 is supported by the mounting surface, and the distance between the board 10 and the mounting is reduced by the gravity, improving the effectiveness of the board 10 in preventing wind, dust, or liquid.

Figure 4:
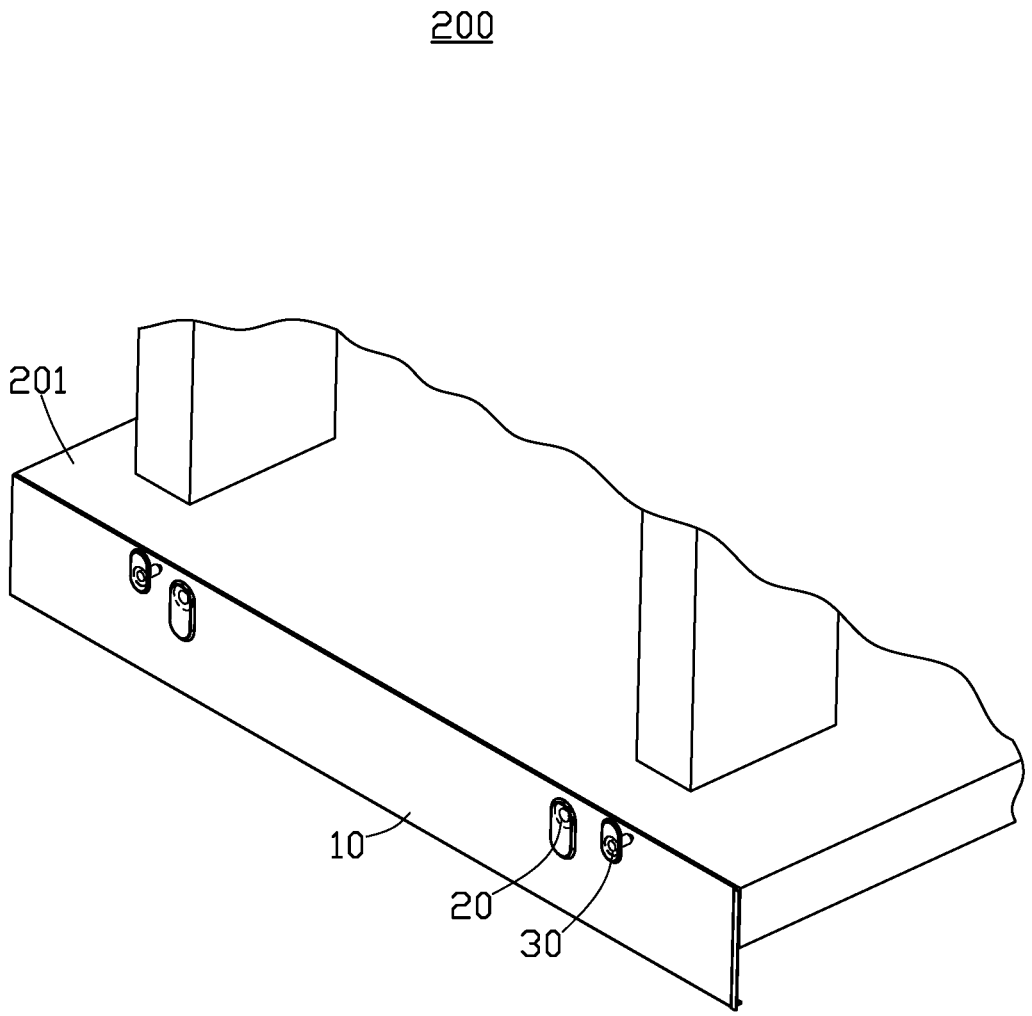
FIG. 4 is an isometric, assembled view of the baffle structure and a main body of a cabinet.
Figure 5:
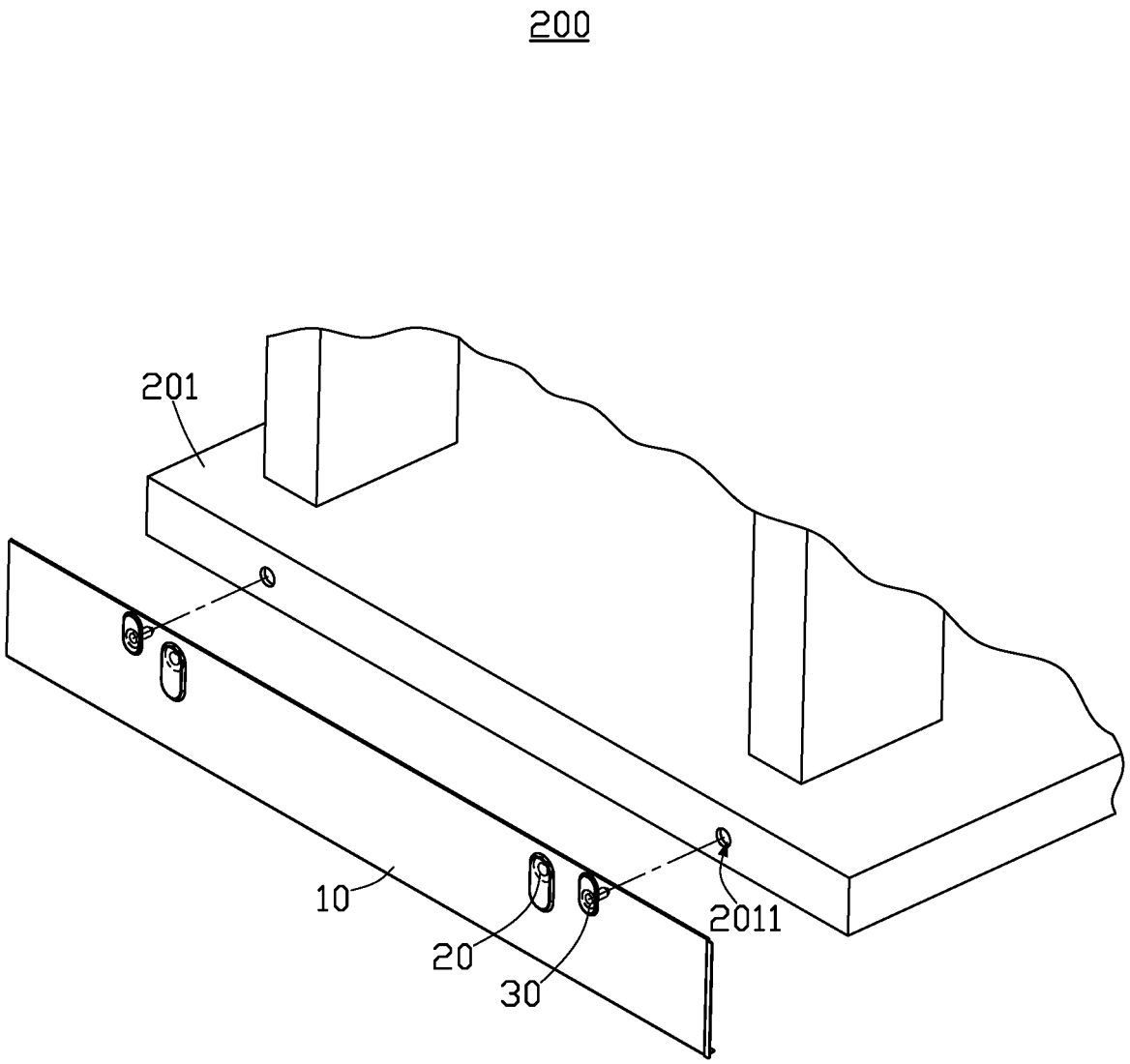
FIG. 5 is an isometric, exploded view of the baffle structure and the main body.

As show in FIG. 4 and FIG. 5, an embodiment provides a cabinet 200. The cabinet 200 comprises the main body 201 and the baffle structure 100. The baffle structure 100 is adjustable and mounted on the main body 201. A connecting part 2011 is defined on the main body 201. The connecting part 2011 is connected to adjusting element 30 to limit the displacement of the board 10 and the main body 201 in the second direction X.

In an embodiment, the board 10 comprises a first plate body 11 and a second plate body 13. The first plate body 11 and the second plate body 13 are connected and set sequentially along the third direction Z. The first slot 101 comprises a first sub slot 1013 and a second sub slot 1015. The first sub slot 1013 is defined on the first plate body 11. The second sub slot 1015 is defined on the second plate body 13.

Figure 3:
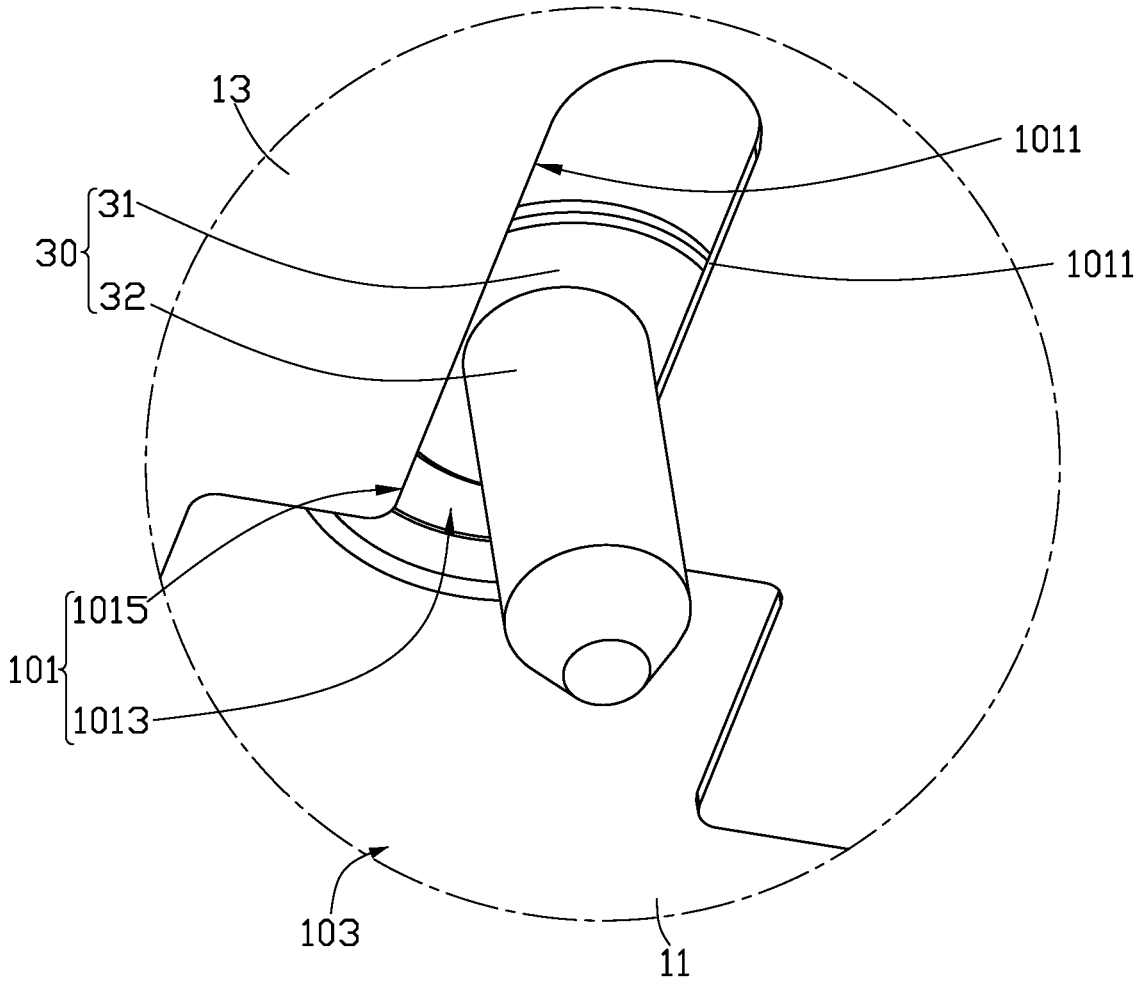
FIG. 3 is a partial view of Part A of the baffle structure shown in FIG. 1.

As show in FIG. 3, in an embodiment, the adjusting element 30 comprises a first structural part 31 and a second structural part 32. The first structural part 31 is slidably arranged in the first sub slot 1013. The part of the second structural part 32 is slidably arranged in the second sub slot 1015, and the other part of the second structural part 32 extends to the side of the second sub slot 1015 away from the first sub slot 1013 to be able to cooperate with the main body 201. The first plate body 11 and the second plate body 13 are located on opposite sides of the first structural part 31 along the third direction Z to limit the displacement of the first structural part 31 along the third direction Z.

In an embodiment, the connecting part 2011 is a hole with a simple structure, and the second structural part 32 is inserted into the connecting part 2011.

When the baffle structure 100 approaches the main body 201, the second structural part 32 is inserted into the connecting part 2011. The board 10 moves along the first direction Y by the action of the gravity or an external force, and one end of the board 10 contact the mounting surface. According to the change in the distance between the main body 201 and the mounting surface along the first direction Y, the adjusting element 30 slides relative along the first direction Yin the first slot 101 to complete the initial fixation of the baffle structure 100. The fixing element 20 is adsorbed onto the main body 201 along the third direction Z. When disassembling the baffle structure 100, apply an external force in the opposite direction of third direction Z to detach the baffle structure 100 and the main body 201.

Figure 6:
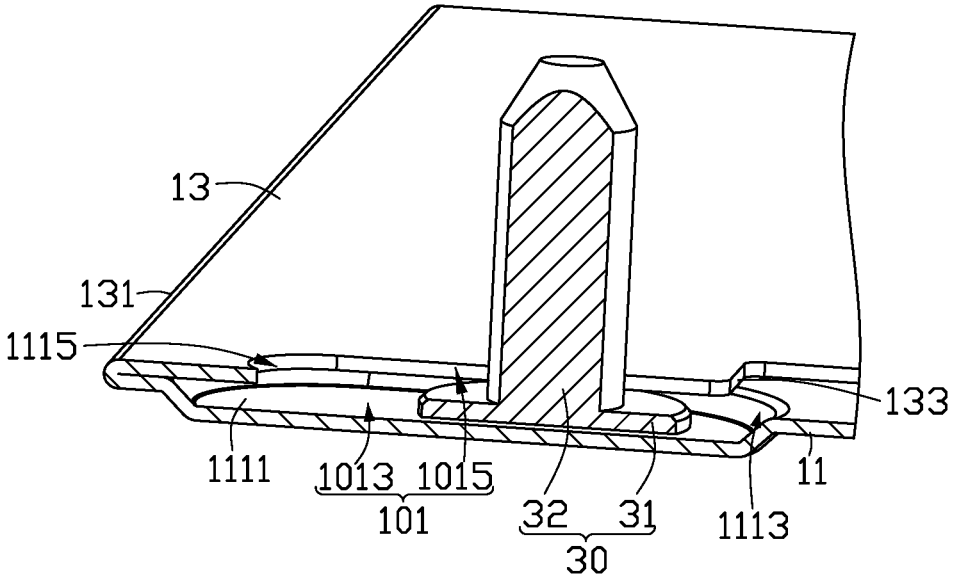
FIG. 6 is a section view of the baffle structure shown in FIG. 1 along the VI-VI line.

As show in FIG. 6, in an embodiment, the bottom wall 1111 of the first sub slot 1013 and second plate body 13 are abut with the first structural part 31 to limit the displacement of the adjusting element 30 in the third direction Z. For example, in another embodiment, the spacing between the bottom wall 1111 and the second plate body 13 along the third direction Z could be greater than the thickness of the first structural part 31 along the third direction Z, and the first structural part could move along the third direction Z within the first sub slot 1013, as long as the adjusting element 30 could not separated from the board 10.

In an embodiment, the second plate body 13 comprises a first end 131 and second end 133. The first end 131 is connected to the first plate body 11. The projection of the second end 133 on the first plate body 11 along the third direction Z is located within the first sub slot 1013. The second sub slot 1015 penetrates at the second end 133 to form the first opening 103.

The board 10 could be elastically deformed, enabling the first structural part 31 to enter the first sub slot 1013 from the first opening 103. For example, the connection between the first plate body 11 and the second plate body 13 could be elastically deformed. The second plate body 13 is tilted relative to the first plate body 11, and the cross section of the first opening 103 becomes larger, enabling the first structural part 31 to pass through the first opening 103. Alternatively, the first plate body 11 or the second plate body 13 can be elastically deformed to make the cross section of the first opening 103 larger.

In an embodiment, the first structural part 31 is a disk shaped structure, and the second structural part 32 is a cylindrical structure. The circular and cylindrical structures have smooth outer contours, which provides less friction resistance and smoother movement during sliding. In another embodiment, at least one of the first structural part 31 and the second structural part 32 could be a conical column, a rectangular column, or a column structure with a cross-section of other shapes.

In an embodiment, the first structural part 31 and the second structural part 32 are integrally formed structures, facilitating processing and saving processing costs. In another embodiment, the first structural part 31 and the second structural part 32 could be detachably connected.

The first sub slot 1013 comprises a first groove wall 1113. The second sub slot 1015 comprises a second groove wall 1115. The first groove wall 1113 is located at the first end 131 of the first sub slot 1013. The first groove wall 1113 and the second groove wall 1115 are located on opposite sides of the fixing element 20 along the first direction Y. The first groove wall 1113 stops the first structural part 31, and the second groove wall 1115 stops the second structural part 32 to prevent the fixing element 20 from detaching from the board 10 along first direction Y.

Figure 7:
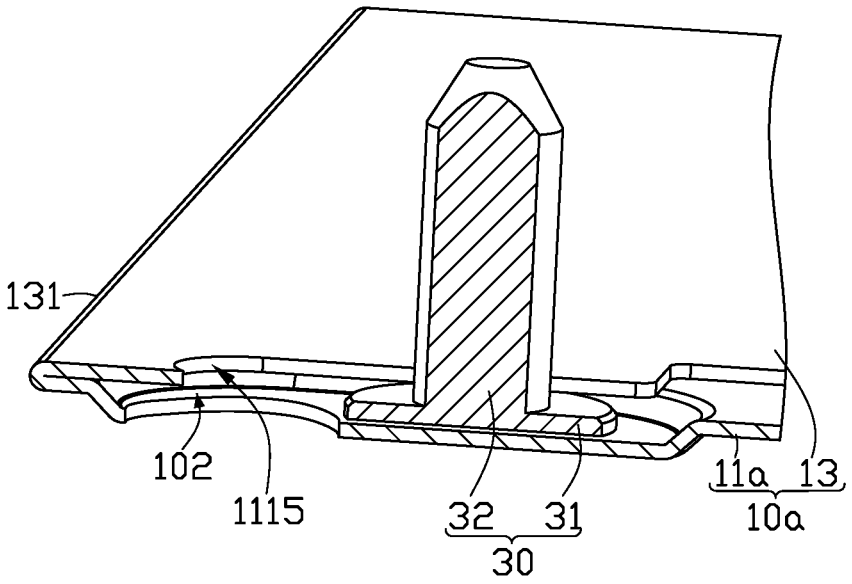
FIGS. 7 and 8 are sectional views of the baffle structure shown in FIG. 6 in different embodiment, respectively.

As shown in FIG. 7. in another embodiment, the difference between the board 10*a* and the board 10 shown in FIG. 5 is that the first plate body 11*a* is provided with a first hole 102. The first hole 102 is closer to the first end 131 than the second end 133 of the second plate body 13. The board 10*a* could be elastically deformed to tilt the adjusting element 30 enter the first slot 101 through the first hole 102. For example, when the first plate body 11*a* is tilted relative to the second plate body 13, the second sub slot 1015 moves towards the first end 131 until the second sub slot 1015 is approximately parallel to the axis of the second structural part 32. The second structural part 32 passes through the first hole 102, first sub slot 1013, and second sub slot 1015, and the first structural part 31 enters the first sub slot 1013.

The projection of the second groove wall 1115 near the first end 131 on the first plate body 11*a* along the third direction Z is located in the first hole 102, and the second groove wall 1115 is close to the first hole 102. The second groove wall 1115 is close to the first hole 102, and the deformation amount of board 10*a* required for adjusting element 30 to enter the first slot 101 from the first hole 102 is reduced.

When the adjusting element 30 moves along the first direction Y until it contacts the first groove wall 1113 and second groove wall 1115 on opposite sides of the first slot 101, at least part projection of the first structural part 31 along third direction Z on the first plate body 11*a* is located outside the first hole 102. That is, after adjusting the element 30 is installed on the board 10*a*, and the first plate body 11*a* restricts the first structural part 31 from exiting the board 10*a* through the first hole 102.

Figure 8:
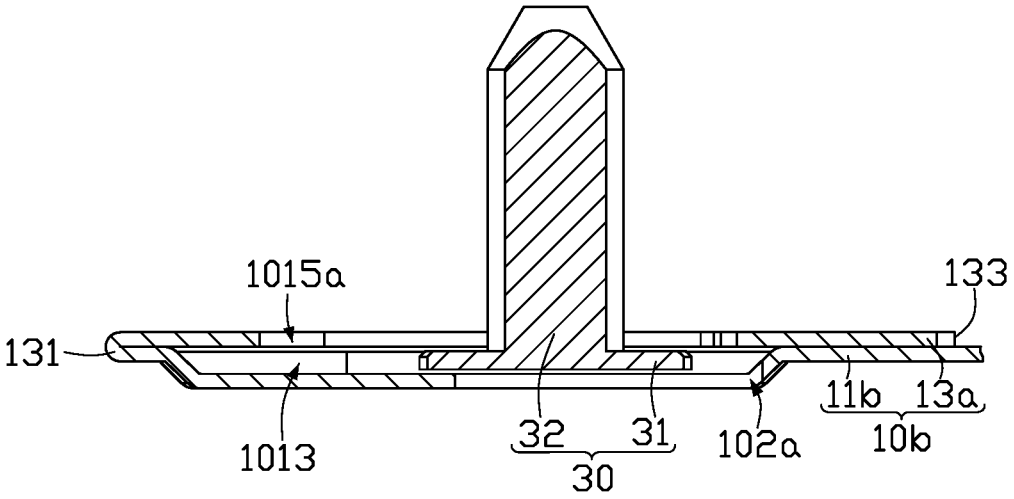

As shown in FIG. 8, in another embodiment, the difference between board 10B and board 10*a* shown in FIG. 7 is that the first hole 102*a* of first plate body 11*b* is closer to the second end 133 than the first end 131. The second end 133 of the second plate body 13*a* is closed. Two groove walls of the second sub slot 1015*a* along the first direction Y are stopped on opposite sides of the second structural part 32. The groove wall projection of second sub slot 1015*a* near the second end 133 along the third direction Z on the first plate body 11 is located in the first hole 102*a*. The board 10*b* could deform elastically, and the adjusting element 30 could enter the first slot 101 through the first hole 102*a*.

As shown in FIGS. 1 and 2, in an embodiment, a third plate body 15 is provided at one end edge of the board 10. The third plate body 15 extends along the third direction Z to contact the mounting surface. The third plate body 15 increases the contact area between the board 10 and the mounting surface, which is conducive to improve the stability of the baffle structure 100 and the main body 201 when fixed.

The third plate body 15 is connected to the end of the first plate body 11 away from the second plate body 13.

In an embodiment, the first plate body 11, the second plate body 13, and the third plate body 15 are made using integrated molding technology.

The third plate body 15 extends towards the side connecting the main body 201. When the baffle structure 100 is fixed to the main body 201, the third plate body 15 is located below the main body 201, which saves installation space and reduce obstacles.

Figure 9:
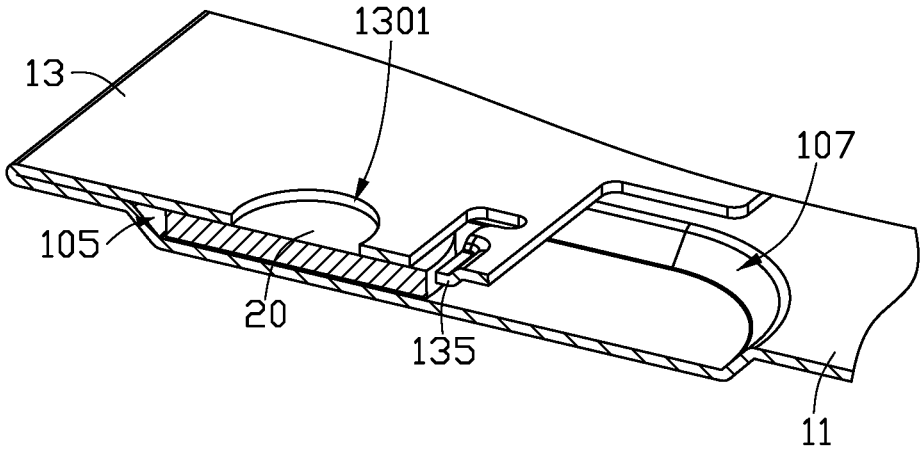
FIG. 9 is a section view of the baffle structure shown in FIG. 1 along the X-X line.

As shown in FIG. 9, in an embodiment, the fixing element 20 is a magnet. The main body 201 is made of metal and adsorbed by magnets. The fixing element 20 adsorbs main body 201 on the third direction Z. The board 10 is fixed to the main body 201 through the fixing element 20 without the need for installation tools, and it is easy to install and disassemble the baffle structure 100.

In another embodiment, the fixing element 20 could be a structure that comprises a magnet.

In an embodiment, the board 10 is made of plastic material, and there is no adsorption force between the plastic and the magnet. The fixing element 20 is fixed to the board 10. In another embodiment, the board 10 could be made of a metal material, and the board 10 and the fixing element 20 are adsorbed together.

In an embodiment, the second plate body 13 is provided with a second hole 1301. The second hole 1301 exposes the portion of the fixing element 20 to enhance the force of the fixing element 20 to adsorb the main body 201. In another embodiment, the second hole 1301 could be omitted.

In another embodiment, the fixing element 20 could be slidably arranged on the board 10 along the first direction Y or along the second direction X, and the fixing element 20 could fix the positions of the board 10 and the main body 201 along the third direction Z.

In another embodiment, the main body 201 is made of non-metallic material, and a metal structure is provided at the position corresponding to the fixing element 20 for adsorption and fixation with the fixing element 20.

In another embodiment, the board 10 is not supported on the mounting surface, but relies on the adsorption force of fixing element 20 onto main body 201 to position board 10 relative to main body 201 along first direction Y.

In another embodiments, the board 10 is not supported on the mounting surface, and the adsorption force of the fixing element 20 onto the main body 201 causes the board 10 to be positioned relative to the main body 201 along the first direction Y.

In an embodiment, a second slot 105 is defined on the board 10. The second slot 105 is formed on the first plate body 11. The fixing element 20 is set in the second slot 105.

The first plate body 11 and the second plate body 13 are located on opposite sides of the fixing element 20 along the third direction Z, and limit the displacement of the fixing element 20 along the third direction Z.

A portion of the second slot 105 is exposed from the side where the second end 133 of the second plate body 13 deviates from the first end 131 to form a second opening 107. A promotion 135 is defined on the second plate body 13, and the protrusion 135 protrudes into the second slot 105. The board 10 could be elastically deformed, and the fixing element 20 enters the second slot 105 through the second opening 107. After the fitting element 20 enters the second slot 105, the board 10 returns to its original shape, and the projection 135 and the groove walls of the second slot 105 stop at the opposite sides of the fitting element 20 along the first direction Y.

In an embodiment, the number of fixing elements 20 is multiple, which can improve the stability of the board 10 when installed on the main body 201, in order to reduce the possibility of rollover.

Preferably, the number of fixing elements 20 is two, and the two fixing elements 20 are arranged along the second direction X, which can reduce costs while improving the stability of the board 10 installed on the main body 201.

Preferably, two fixing elements 20 are symmetrically arranged at both ends of the board 10, which can further improve the stability of the board 10 installed on the main body 201.

Preferably, the number of adjusting elements 30 is at least two, and the guiding effect of the multiple adjusting elements 30 is better, and the stability of the adjusting elements 30 moving along the first slot 101.

The baffle structure 100 could be adjusted according to the position of the main body 201 relative to the mounting surface, and the baffle structure 100 is convenient for installation and disassembly.

The embodiment shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure, up to and including the full extent established by the broad general meaning of the terms used in the claims.

What is claimed is:

1. A baffle structure for installing on a main body of a cabinet, the baffle structure comprising:

a board, wherein a first slot is defined on the board and extends along a first direction;

an adjusting element slidably arranged in the first slot along the first direction, and partially extended outside the first slot to cooperate with the main body to position the board relative to the main body on a second direction;

a fixing element set on the board and configured to position the board relative to the main body on a third direction;

wherein the second direction is perpendicular to the first direction, and the third direction is perpendicular to the first direction and the second direction;

the board comprises a connected first plate body and a second plate body, and the first slot comprises a first sub slot and a second sub slot, the first sub slot is formed on the first plate body, and the second sub slot is formed on the second plate body;

the adjusting element comprises a first structural part and a second structural part, and the first structural part is slidably arranged within the first sub slot, and the second structural part is connected to the first structural part; a portion of the second structural part is slidably arranged on the second sub slot, and the other portion of the second structural part extends to the side of the second sub slot that is away from the first sub slot;

the first plate body and the second plate body are located on opposite sides of the first structural part along the third direction to limit the displacement of the first structural part along the third direction.

2. The baffle structure of claim 1, wherein:

the second plate body comprises a first end and a second end, the first end is connected to the first plate body, and the second sub slot penetrating the second end of the second plate body;

the projection of the second end along the third direction on the first plate body is located within the first sub slot to form a first opening;

the board could be elastically deformed to allow the first structural part to enter the first sub slot from the first opening.

3. The baffle structure of claim 1, wherein:

a first hole is defined on the first plate body, and when the adjusting element moves along the first direction until it contacts the groove walls on opposite sides of the first slot, partial projection of the first structural part on the first plate body along the third direction is located outside the first hole;

the board could be elastically deformed to allow the first structural part to enter the first sub slot from the first hole.

4. The baffle structure of claim 3, wherein:

the projection of one of the opposing two slot walls of the first slot onto the first plate body along the third direction is located within the first hole.

5. The baffle structure of claim 1, wherein:

the fixing element comprises a magnet.

6. The baffle structure of claim 5, wherein:

the first plate body and the second plate body are set along the third direction;

a second slot is defined on the first plate body, and the second slot accommodates the fixing element, and opposite two groove walls of the second slot are located on opposite sides of the fixing element along the second direction;

the first plate body and the second plate body limit the displacement of the fixing element along the first direction and along the third direction.

7. The baffle structure of claim 6, wherein:

a portion of the second slot is exposed from the side of the second plate body away from the connection between the second plate body and the first plate body to form a second opening;

the second plate body is provided with a protrusion protruding into the second slot;

the board could be elastically deformed to allow the fixing element to enter the second slot from the second opening and cross the protrusion.

8. The baffle structure of claim 6, wherein:

a second hole is defined on the second plate body and exposes a portion of the fixing element.

9. The baffle structure of claim 1, wherein:

an edge of one end of the board is provided with a third plate body that extends along the third direction and is used to contact a mounting surface.

10. A baffle structure for installing on a main body of a cabinet, the baffle structure comprising:

a board, wherein a first slot is defined on the board and extends along a first direction;

an adjusting element slidably arranged in the first slot along the first direction, and partially extended outside the first slot to cooperate with the main body to position the board relative to the main body on a second direction;

a fixing element slidably arranged on the board and configured to position the board relative to the main body on a third direction;

wherein the second direction is perpendicular to the first direction, and the third direction is perpendicular to the first direction and the second direction;

the board comprises a connected first plate body and a second plate body, and the first slot comprises a first sub slot and a second sub slot, the first sub slot is formed on the first plate body, and the second sub slot is formed on the second plate body;

the adjusting element comprises a first structural part and a second structural part, and the first structural part is slidably arranged within the first sub slot, and the second structural part is connected to the first structural part; a portion of the second structural part is slidably arranged on the second sub slot, and the other portion of the second structural part extends to the side of the second sub slot that is away from the first sub slot;

the first plate body and the second plate body are located on opposite sides of the first structural part along the third direction to limit the displacement of the first structural part along the third direction.

11. A cabinet, comprising:

a main body, the main body is provided with a connecting part, and a baffle structure, wherein:

the baffle structure comprises:

a board, a first slot is defined on the board and extends along a first direction;

an adjusting element slidably arranged in the first slot along the first direction, and partially extended outside the first slot to cooperate with the main body to position the board relative to the main body on a second direction;

a fixing element set on the board and configured to position the board relative to the main body on a third direction;

the second direction is perpendicular to the first direction, and the third direction is perpendicular to the first direction and the second direction;

the board comprises a connected first plate body and a second plate body, and the first slot comprises a first sub slot and a second sub slot, the first sub slot is formed on the first plate body, and the second sub slot is formed on the second plate body;

the adjusting element comprises a first structural part and a second structural part, and the first structural part is slidably arranged within the first sub slot, and the second structural part is connected to the first structural part; a portion of the second structural part is slidably arranged on the second sub slot, and the other portion of the second structural part extends to the side of the second sub slot that is away from the first sub slot;

the first plate body and the second plate body are located on opposite sides of the first structural part along the third direction to limit the displacement of the first structural part along the third direction.

12. The cabinet of claim 11, wherein:

the second plate body comprises a first end and a second end, the first end is connected to the first plate body, and the second sub slot penetrating the second end of the second plate body;

the projection of the second end along the third direction on the first plate body is located within the first sub slot to form a first opening;

the board could be elastically deformed to allow the first structural part to enter the first sub slot from the first opening.

13. The cabinet of claim 11, wherein:

a first hole is defined on the first plate body, and when the adjusting element moves along the first direction until it contacts the groove walls on opposite sides of the first slot, partial projection of the first structural part on the first plate body along the third direction is located outside the first hole;

the board could be elastically deformed to allow the first structural part to enter the first sub slot from the first hole.

14. The cabinet of claim 13, wherein:

the projection of one of the opposing two slot walls of the first slot onto the first plate body along the third direction is located within the first hole.

15. The cabinet of claim 11, wherein:

the fixing element comprises a magnet.

16. The cabinet of claim 15, wherein:

the first plate body and the second plate body are set along the third direction;

a second slot is defined on the first plate body, and the second slot accommodates the fixing element, and opposite two groove walls of the second slot are located on opposite sides of the fixing element along the second direction;

the first plate body and the second plate body limit the displacement of the fixing element along the first direction and along the third direction.

17. The cabinet of claim 16, wherein:

a portion of the second slot is exposed from the side of the second plate body away from the connection between the second plate body and the first plate body to form a second opening;

the second plate body is provided with a protrusion protruding into the second slot;

the board could be elastically deformed to allow the fixing element to enter the second slot from the second opening and cross the protrusion.

18. The cabinet of claim 16, wherein:

a second hole is defined on the second plate body and exposes a portion of the fixing element.

* * * * *